US007267179B1

(12) United States Patent
Abel

(10) Patent No.: US 7,267,179 B1
(45) Date of Patent: Sep. 11, 2007

(54) METHOD FOR RAPID INSTALLATION OF A SMALLER DIAMETER PRESSURE CONTROL DEVICE USABLE ON BLOW OUT PREVENTERS

(76) Inventor: Leo William Abel, 2907 W. Lane Dr., Houston, TX (US) 77027

( * ) Notice: Subject to any disclaimer, the term of this patent is extended or adjusted under 35 U.S.C. 154(b) by 296 days.

(21) Appl. No.: 11/021,941

(22) Filed: Dec. 22, 2004

Related U.S. Application Data

(60) Provisional application No. 60/541,034, filed on Feb. 2, 2004.

(51) Int. Cl.
*E21B 19/00* (2006.01)

(52) U.S. Cl. ..... 166/379; 166/72; 166/84.5

(58) Field of Classification Search ..... 166/379, 166/351, 354, 85.4
See application file for complete search history.

(56) References Cited

U.S. PATENT DOCUMENTS 6,390,194 B1 * 5/2002 Young et al. ..... 166/250.08
6,817,421 B2 * 11/2004 Dallas ..... 166/379
2005/0006103 A1 * 1/2005 McGuire et al. ..... 166/379

* cited by examiner

*Primary Examiner*—David Bagnell
*Assistant Examiner*—Brad Harcourt
(74) *Attorney, Agent, or Firm*—Buskop Law Group, PC; Wendy Buskop

(57) ABSTRACT

The method for rapid installation of a smaller diameter pressure control device usable on an annular BOP or any type of BOP. The step are first installing a flange with a threaded profile upon an annular BOP. Next, install a bell nipple on the flange, then install a first test plug in the base of the BOP or the base of the stack of BOPs. Then install a second test plug into the threaded profile of flange. Perform a pressure test on the flange and all sealing aspects of the annular BOP; depressurizing the flange and removing the test plug. Install a thread protector between flange and the bore of the annular BOP. Next initiate drilling operations; and upon indication of the need for wireline operations, or adapting the existing BOP to smaller working diameter pressure control device, remove the thread protector and install a high pressure assembly.

24 Claims, 9 Drawing Sheets

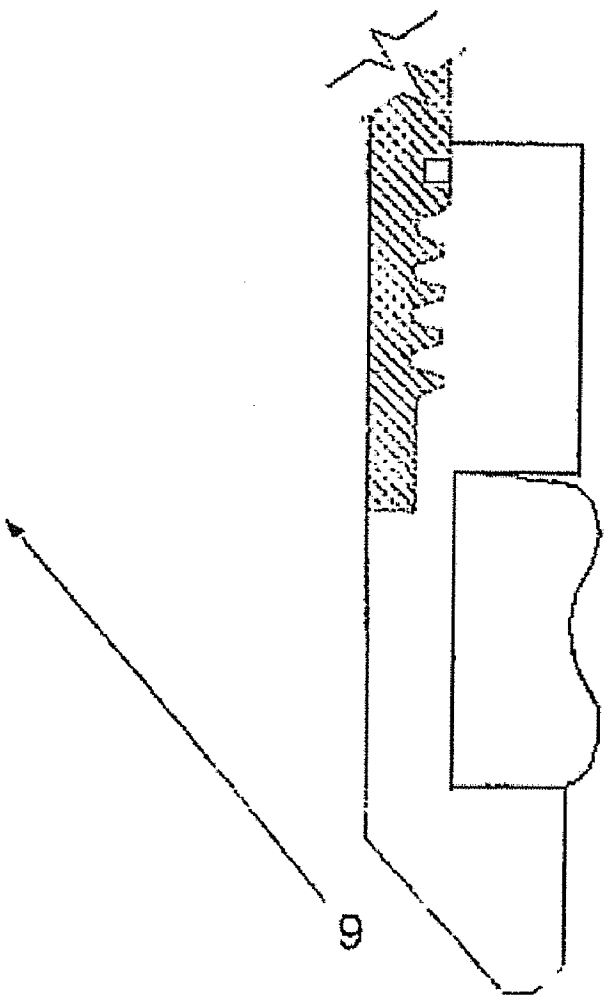
FIG. 9
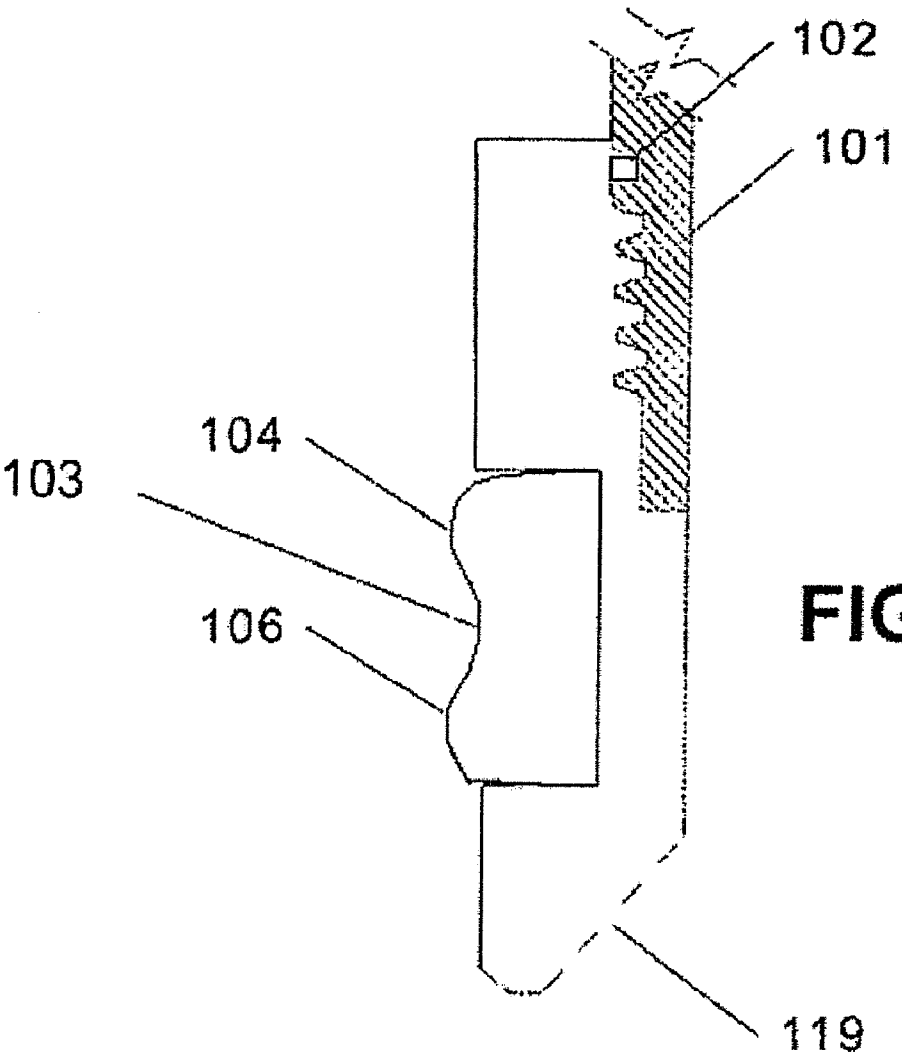

METHOD FOR RAPID INSTALLATION OF A SMALLER DIAMETER PRESSURE CONTROL DEVICE USABLE ON BLOW OUT PREVENTERS

FIELD

The invention relates to an adaptor for use in wireline assemblies for oil wells, natural gas wells, geothermal wells, water wells, preferably at the surface of the well.

The invention relates to a method for rapid installation of a smaller diameter pressure control device.

The installation is for use on an annular blow out preventer BOP or any type of BOP, preferably on oil wells, natural gas wells, gas hydrate, sulfur, geothermal wells, water wells, injection wells and any mineral extraction via well bores in the earth, preferably at the surface of the well.

BACKGROUND

The current application claims priority to the co-pending provisional patent application filed Feb. 2, 2004, Ser. No. 60/541,034 entitled "Method for Rapid Installation of a Smaller Diameter Pressure Control Device Usable on an Annular Blow Out Preventer".

Currently, for oil and gas well, blow out preventers are installed using a rig bell nipple. When those nipples are removed, usually two individuals must climb up a BOP to undo about twelve bolts and remove the nipple. The BOP has limited space and is filthy and dirty with poor lighting. The individual must then get a high pressure version of the bell nipple, energize the bell nipple, and then cross over to the BOP. The usual work time required for these actions is between six and eight hours.

Other apparatus and methods for performing wireline operation in a well are described in Young U.S. Pat. No. 4,836,289, Ables U.S. Pat. No. 5,615,737, and Portman U.S. Pat. No. 6,209,652.

A need has existed for a system where people do not have to replace the bell nipple at unreasonable times. A need has exists for a system the can do such an installation of a bell nipple in less than one hour, rather than six hours.

BRIEF DESCRIPTION OF THE DRAWINGS

In the detailed description of the preferred embodiments of the method presented below, reference is made to the accompanying drawings, in which:

FIG. 9 is a detailed cross section of the lower seal assembly.

Figure 1:
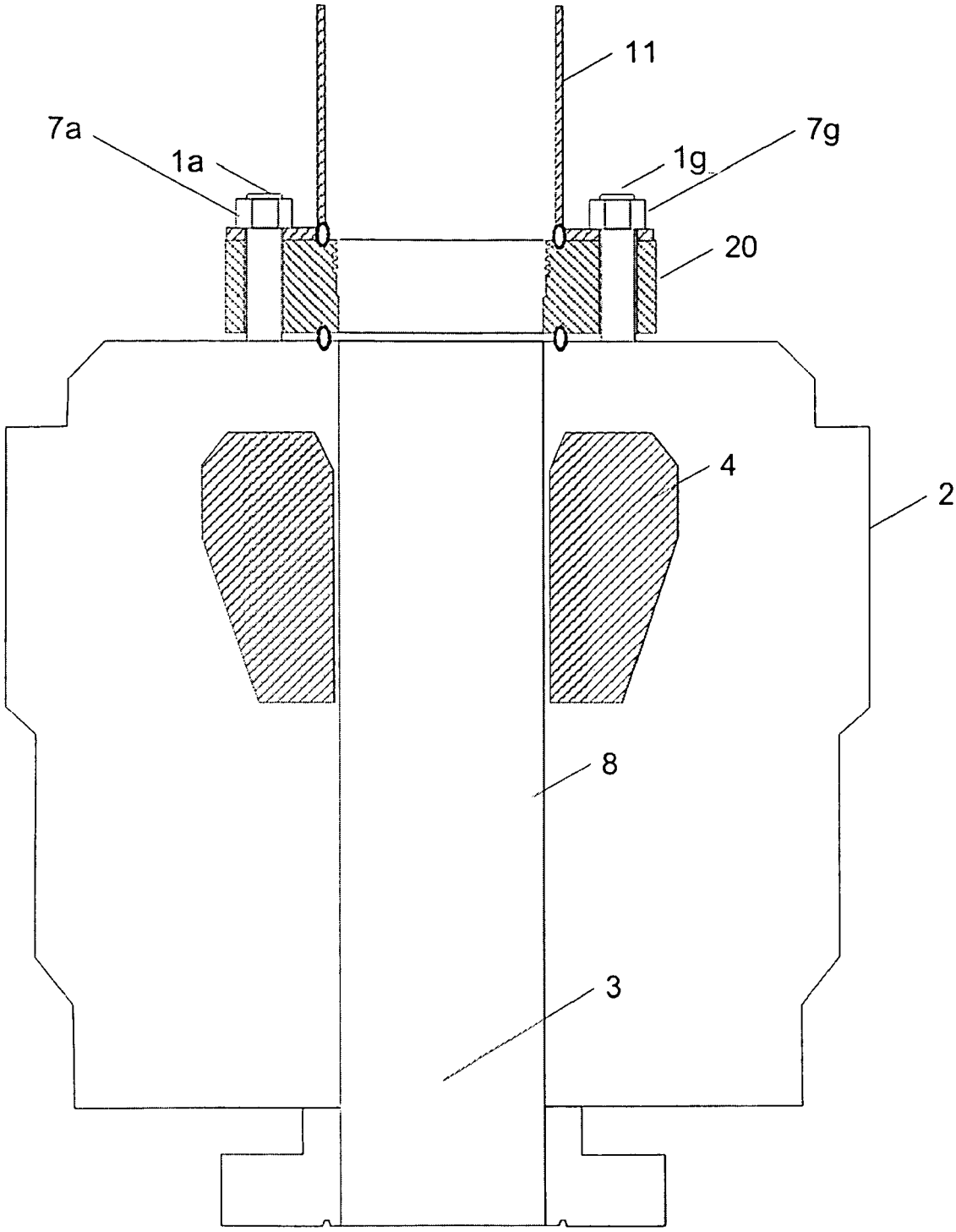
FIG. 1 depicts the installation of the flange used in the method.

The present method is detailed below with reference to the listed Figures.

DETAILED DESCRIPTION OF THE PREFERRED EMBODIMENTS

Before explaining the present method in detail, it is to be understood that the method is not limited to the particular embodiments and that it can be practiced or carried out in various ways.

The present invention saves time in installing pressure control equipment for wireline operations. The invention can be used to save time in installing smaller bore pressure control equipment onto larger diameter BOPs, such as coil tubing, pumping, and reduced bore operations like fishing and pumping operations. The present invention adds a second flow barrier during the smaller bore operations that is a significant environmental advantage over all known system.

The present invention also has a dramatic improved safety feature of providing a second flow barrier or a secondary pressure seal to prevent the release of oil, natural gas, or water in an uncontrolled manner.

The invention results in a dramatic decrease in the need for labor and exposure to hazards of climbing, working under a hoist, poor lighting and the generally dirty working environment for installation and de-installation of a rig bell nipple during the course of operation of the well.

The High Pressure Shooting Nipple (HPSN) is a device that reduces risks to personnel, the well and the environment. It also offers a means to increase the reliability of blow out preventers by allowing pressure testing for the upper section of the BOP, which is not normally done in non-HPSN applications.

The HPSN reduces the large BOP diameters to smaller diameters for wireline, snubbing and pumping operations in such a way that the full working pressure of the BOP is maintained for the small BOP operations (e.g., no compromise is made for pressure integrity). Other methods to reduce the time it takes to change the bell nipple are not full working pressure systems and therefore the advantage of the HPSN is its ability to work at full pressure and is still less likely to leak and create a health hazard or risk of pollution.

The HPSN has triple redundant pressure seals: lower cup testing type, annular element seal and lip seal in the hold down flange. A leak during drilling and work over operations can cause huge pollution risks, the triple redundancy of the HPSN dramatically reduces the risk of a leak thereby reducing pollution risks.

There is little risk that HPSN will be pushed out of the well when operating under pressure because it has structural integrity thru its threaded attachment to the BOP that resists upward and downward forces.

The HPSN uses very simple methods to install and remove the HPSN thereby eliminating risks of climbing to personnel or use of equipment and hammers to install large diameter bolts and nuts as is required in other methods. HPSN installs from above the BOP stack and does not require climbing the stack in an inherently dirty and dark section of the rig, namely on top of the BOP stack. HPSN installs and removes in short order using a course type machine thread (8 turns of low torque to the right to install and to the left to remove).

With reference to the figures, FIG. 1 through FIG. 4 depict the various stages of the method.

FIG. 1 depicts the first stage of the method for rapid installation of smaller diameter pressure control devices that are usable on annular blow out preventers BOP begins by installing a flange 20 with a threaded profile upon an annular BOP 2. The annular BOP 2 has a bore 3 and annular seals 4. The flange 20 is installed on the top portion of the annual BOP using studs 1*a* and 1*g* with installing nuts 7*a* and 7*g*. A pressure control device 11 is installed above the flange 20. The method can also be used to install smaller diameter pressure control devices on a stack of BOPs. The lower body 8 has a bore 3 within the BOP 2.

The method continues by installing a bell nipple in the bore of the BOP, installing nuts 7*a* and 7*g* over the studs, tightening the nuts.

Figure 2:
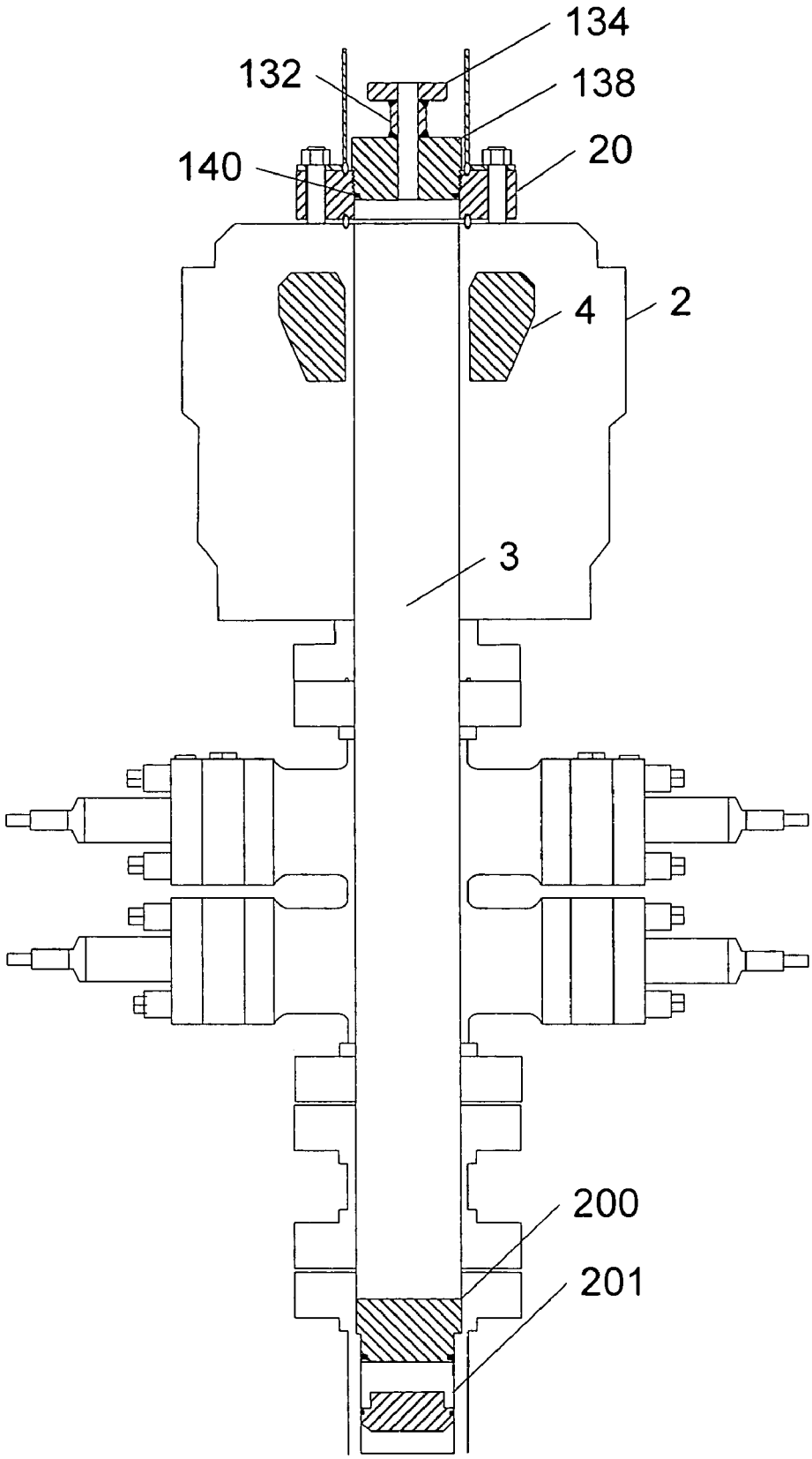
FIG. 2 depicts the installation of the test plug used in the invention.

FIG. 2 depicts the first test plug 200 installed in the wellhead below the BOP or the casing below 201 the stack of BOPs. The second test plug 138 is installed into the threaded profile of flange 20. This method allows the upper portion of the annular BOP 2 to be fully tested for seal 140 integrity. The BOP 2 has annular seals 4, within the BOP 2. A second test plug would be screwed into the flange 20. The second test plug has a pipe 132 with a bore for connecting a cap 138 and a pipe pressure attachment 134. It is contemplated that the pipe pressure attachment 134 is a testing flange or a hammer union. A testing seal 140 can be embedded into the cap 138.

The upper portion comprises a first seal is a ring gasket seal between the hold down flange and the annular BOP and a second seal is the cap seal between the annular BOP and the upper body of the annular BOP. These two seals are not usually tested, or able to be tested by other known commercial methods. The importance of pressure testing this seal testing is to provide an assurance that the when the BOP is installed, the seals will hold when drilling is performed. The seals must create a good seal to prevent a blow out, pollution, physical damage and possible loss of life on the rig.

A pressure test is performed on the flange 20 and all sealing aspects of the annular BOP and the BOP stack. The flange 20 is de-pressurized and the test plug is removed.

Figure 3:
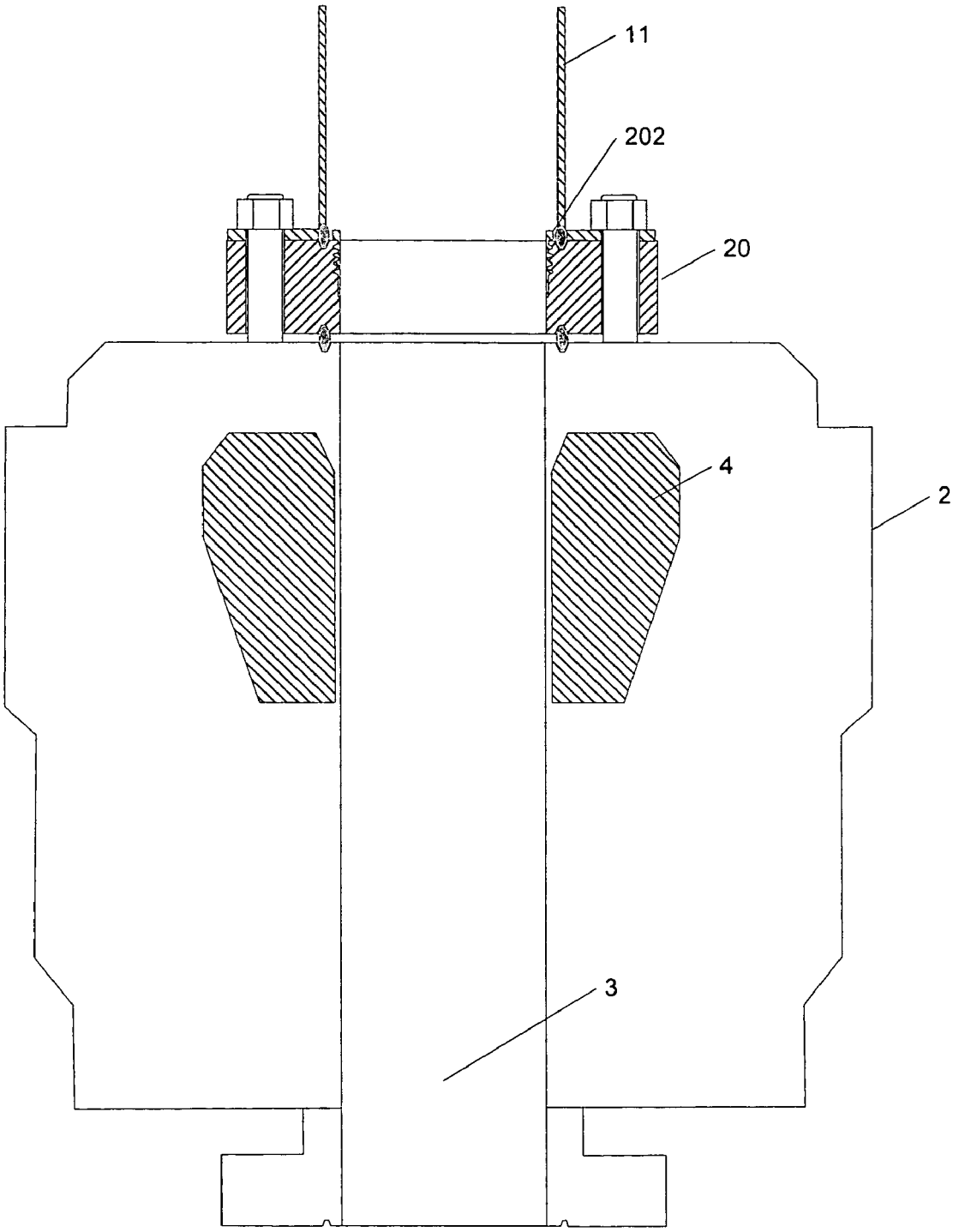
FIG. 3 depicts the installation of the thread protector.

FIG. 3 depicts the installing of a thread protector 202 between the flange 20 and the bore 3 of the annular BOP 2 before drilling operations are initiated. The annular BOP 2 has a bore 3 and annular seals 4 and a pressure control device 11 is installed above the flange 20.

Figure 4:
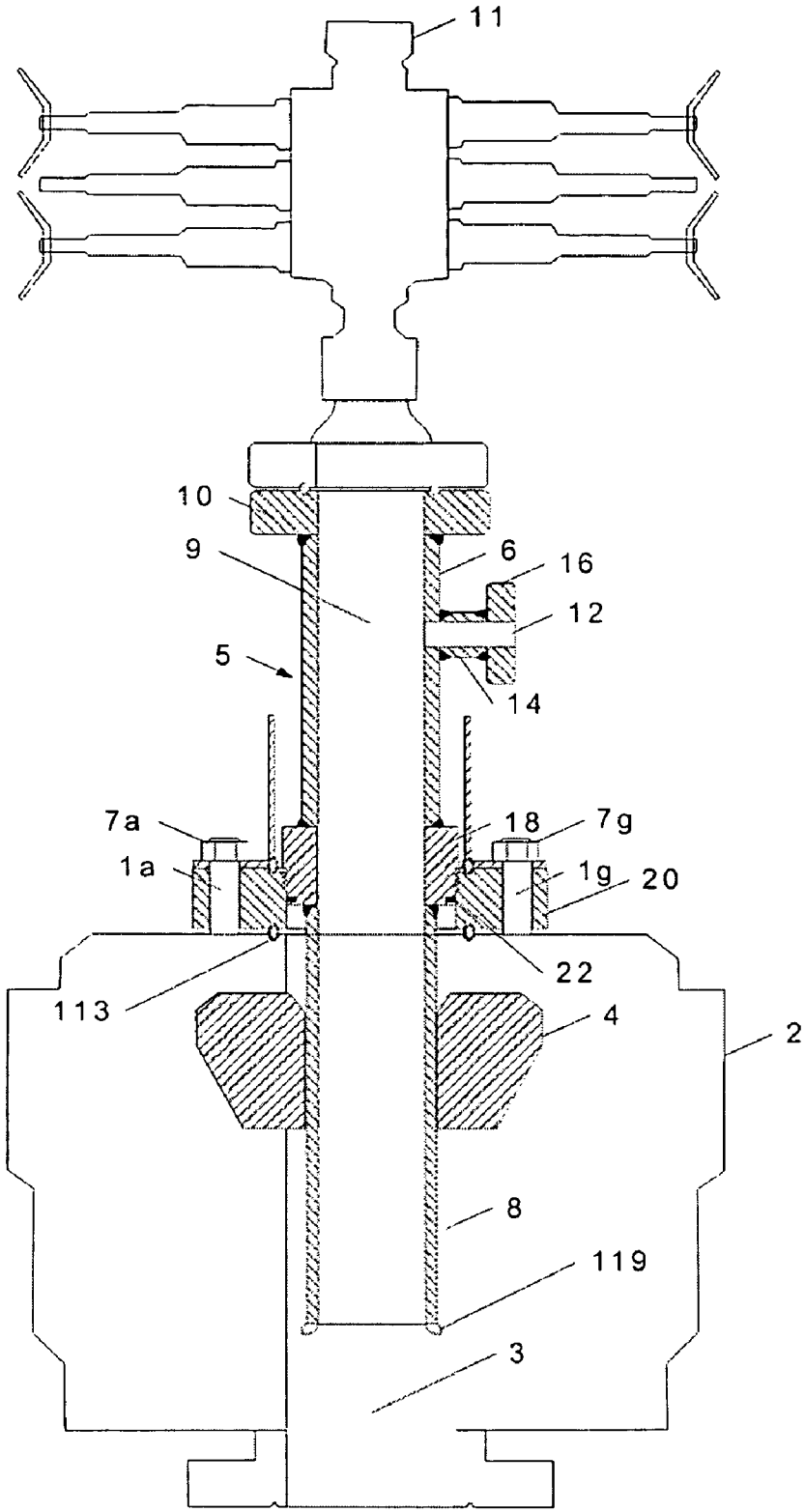
FIG. 4 depicts the installed assembly.

FIG. 4 depicts a side view of high pressure adaptor assembly 5 engaged with an annular blow out preventer (BOP) 2 having a bore 3 with annular seals 4. The adaptor 5 can be short on land or very long when used offshore. It is possible that the adaptor can be up to 4500 meters or more.

The high pressure adaptor assembly includes an upper body 6 and a lower body 8 with a bore 9 that communicates between the upper and the lower body and the bore of the annular blow out preventer (BOP). The assembly has a top flange 10 connected to the upper body 6 that also connects to a pressure control device 11, such as a wireline BOP or a valve. The pressure control device 11 also can be a coiled tubing blow out protector, a base of a snubbing unit, or any other smaller bore BOP.

One of the features of the invention is to enable wireline operations to work better. Another feature of the invention is to enable drillers to reduce the working bore of a BOP of a well for various purposes. This improves the flexibility of drilling, making drilling more cost effective. The invention enables a large bore BOP, such as one with an 11 inch bore to be safely and easily connected to a 2 1/16 bore BOP, 3 1/16 bore BOP, 4 1/16 bore BOP, or 7 1/16 bore BOP. This can be used to reduce a very large BOP to a very small BOP.

A side outlet port 12 is integral with the upper body 6 and connects to the bore 9. The side outlet port 12 has a port body 14 and a side flange 16. The side flange 16 can engage a valve (not shown), and the valve then can engage a line that can be used for pump-in or bleed-off of well fluids.

A self energizing hold down assembly 18 is welded between the upper body 6 and the lower body 8. The male section is typically a threaded profile.

A flange 20 is used for connecting to the hold down assembly 18 male section. The flange 20 has a female engagement section 21 is shown in FIG. 2, for engaging with the male engagement section 19.

A coarse buttress type thread having a pitch of four to eight threads per inch is a preferred embodiment for the threaded engagement between the male engagement section and the female engagement section. It is possible to have a threaded engagement that is as few as two threads per inch and as many threads as desired per inch for secure engagement and be usable within the scope of the invention. Typically, eight threads per inch would be considered the normal maximum.

A seal 22 provides a pressure barrier to prevent fluids from passing out of the bore 3 of the well. Studs and nuts are used to hold the flange 20 to the BOP 2. As shown, these studs and nuts energize a ring gasket seal 113 for increased environmental safety. FIG. 4 depicts only two studs 1*a* and 1*g* and two bolts 7*a* and 7*g*. In a preferred embodiment for an 11 inch, 5000 psi working pressure BOP, twelve studs and twelve bolts are used to energize the ring gasket seal 113. A wireline reentry guide 119 can be used for the high pressure adapter assembly.

When wireline operations are needed or when the BOP is crossed to a smaller working diameter pressure for other operations, the thread protector is removed and the high pressure assembly is installed.

Figure 5:
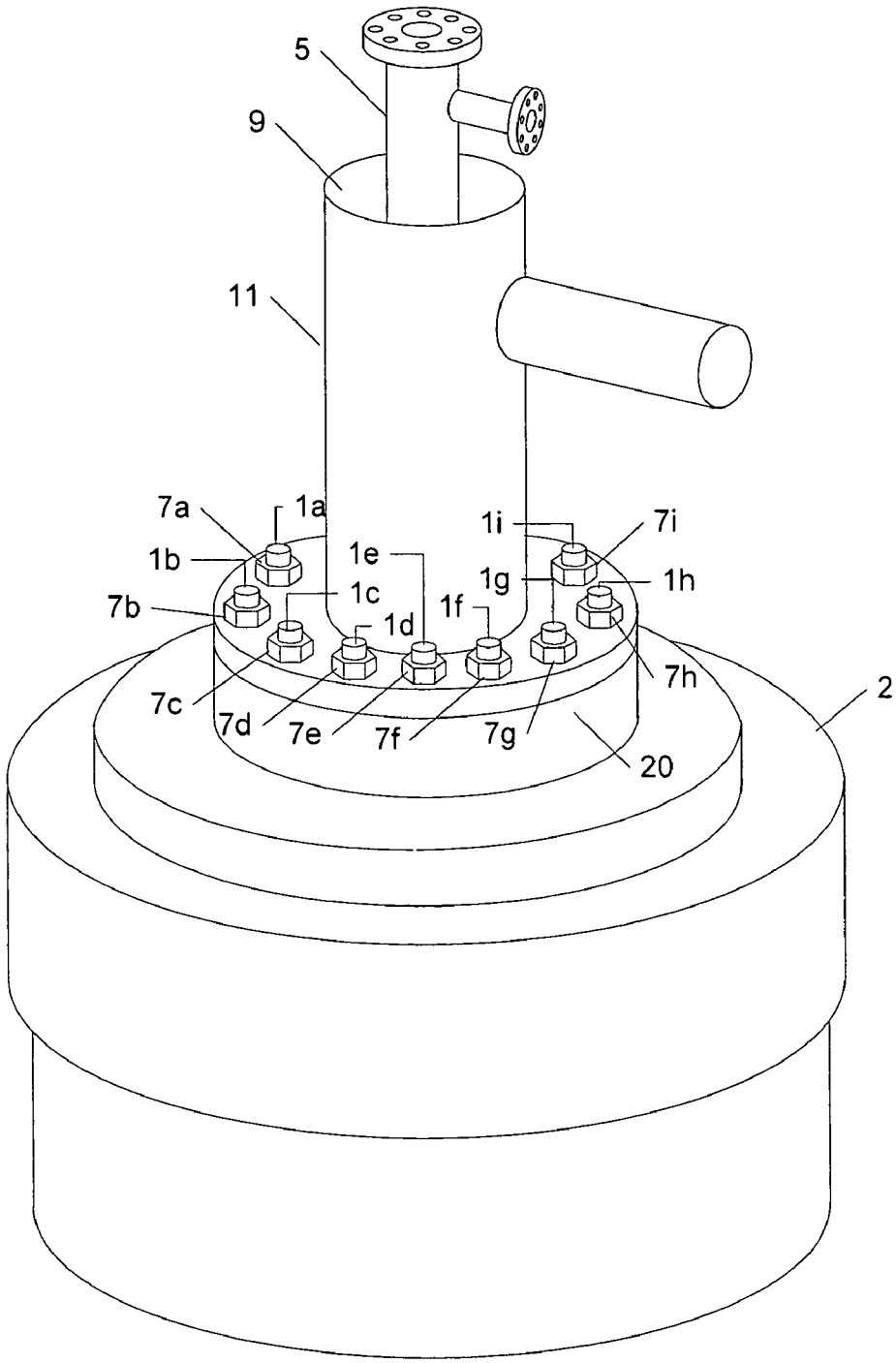
FIG. 5 depicts a perspective view of the shooting nipple assembly usable in the method.

FIG. 5 depicts a perspective view of the high pressure adaptor assembly 5 engaged with an annular blow out preventer BOP 2. The flange 20 is installed on the top portion of the annual BOP using studs 1*a*, 1*b*, 1*c*, 1*d*, 1*e*, 1*f*, 1*g*, 1*h*, and 1*i* with installing nuts 7*a*, 7*b*, 7*c*, 7*d*, 7*e*, 7*f*, 7*g*, 7*h*, and 7*i*. The pressure control device 11 is also shown with bore 9.

The high pressure adaptor assembly can have an upper body and a lower body with a bore that communicates between the upper and the lower body and the bore of the annular blow out preventer BOP. The assembly can have a top flange connected to the upper body that also connects to a pressure control device, such as a wireline BOP or a valve. The pressure control device also can be a coiled tubing blow out protector, a base of a snubbing unit, or any other smaller bore BOP.

One of the features of the invention can be to enable wireline operations to work better. Another feature of the invention is to enable drillers to reduce the working bore of a BOP of a well for various purposes. This improves the flexibility of drilling, making drilling more cost effective. The invention enables a large bore BOP, such as one with an 11 inch bore to be safely and easily connected to a 2 1/16 bore BOP, 3 1/16 bore BOP, 4 1/16 bore BOP, or 7 1/16 bore BOP.

A side outlet port can be integral with the upper body connecting to the bore. The port has a port body and a side flange. The side flange can engage a line for pump in or bleed off of well fluids. The side outlet port can be opened to pump in a foreign fluid into the well or it can be used to bleed off oil, gas, water, or other well fluids.

Figure 6:
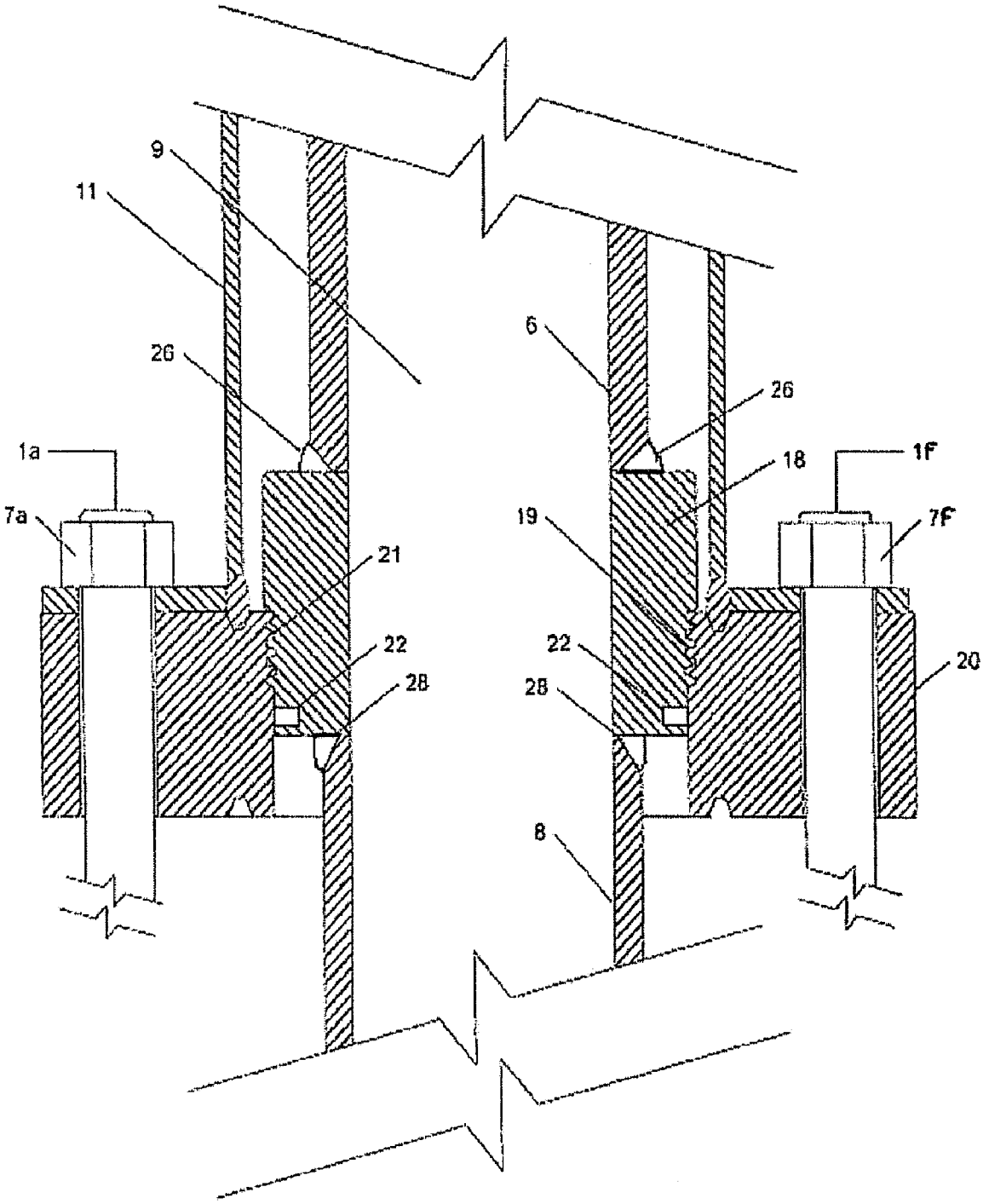
FIG. 6 depicts a detail from the side view of the shooting nipple assembly shooting the hold down assembly usable in the method.

FIG. 6 depicts a self energizing hold down assembly 18 having a male engagement section 19 welded between the upper body 6 and the lower body 8. The male section is typically a threaded profile.

A flange 20 is used for connecting to the hold down assembly 18 male section comprising a female engagement section 21, for engaging with the male engagement section 19.

A coarse buttress type thread having a pitch of four threads per inch is a preferred embodiment for the threaded engagement between the male engagement section and the female engagement section. It is possible to have a threaded engagement that is as few as two threads per inch and as many threads as desired per inch for secure engagement and be usable within the scope of the invention. Typically, eight threads per inch would be considered the normal maximum.

A seal 22 provides a pressure barrier to prevent fluids from passing out of the bore 9 of the well. A pressure control device 11 is connected to the flange 20. Studs and nuts are used to hold the flange 20 to the BOP 2. As shown, these studs and nuts energize a ring gasket seal for increased environmental safety. Two studs 1*a* and 1*g* and two bolts 7*a* and 7*g* are shown in the figure. In a preferred embodiment for an 11 inch, 5000 psi working pressure BOP, twelve studs and twelve bolts are used to energize the ring gasket seal. A wireline reentry guide 119 can be used for the high pressure adapter assembly.

FIG. 6 depicts a detailed of the hold down assembly that includes a seal 22 disposed between the connected male and female engagement sections and the lower body 8. In the most preferred embodiment, seal 22 is a notch in the hold down assembly 18 that is filled with an elastomer. Preferably, this is a self energizing elastomer. It can be an O-ring in another embodiment. The lower body engages the annular seal 26 of the BOP.

FIG. 6 depicts that a first weld 26 and a second weld 28 can be used to connect the hold down assembly 18 to the upper body 6 and the lower body 8, respectively. The first and second welds are preferably metal welds that are compatible with the alloy of the upper body and the lower body. It is also contemplated that the alloy material of the first weld could be different than that of the second weld, the weld 26 is subject to bending stress and often has greater loads than weld 28.

For example, a weld 26 may need to be a type of material with a 150,000 psi yield strength whereas weld 28 may only need to be a type of materials with a 80,000 psi yield strength. FIG. 6 depicts in detail how the female threaded engagement 21 and the male engagement section 19 connect.

In an alternative embodiment, the welds could be replaced to have high pressure gas tight casing threads and then the hold down assembly could be threaded to the lower body and the upper body.

In a version of the invention the top flange can be connected to the upper body for connection with a pressure control device. A side outlet port can be disposed in the upper body integrally connected to the bore having a port body and a side flange. The side flange can engage a line for pump in or bleed off of well fluids. A self energizing hold down assembly can be disposed between the upper body and the lower body.

Figure 7:
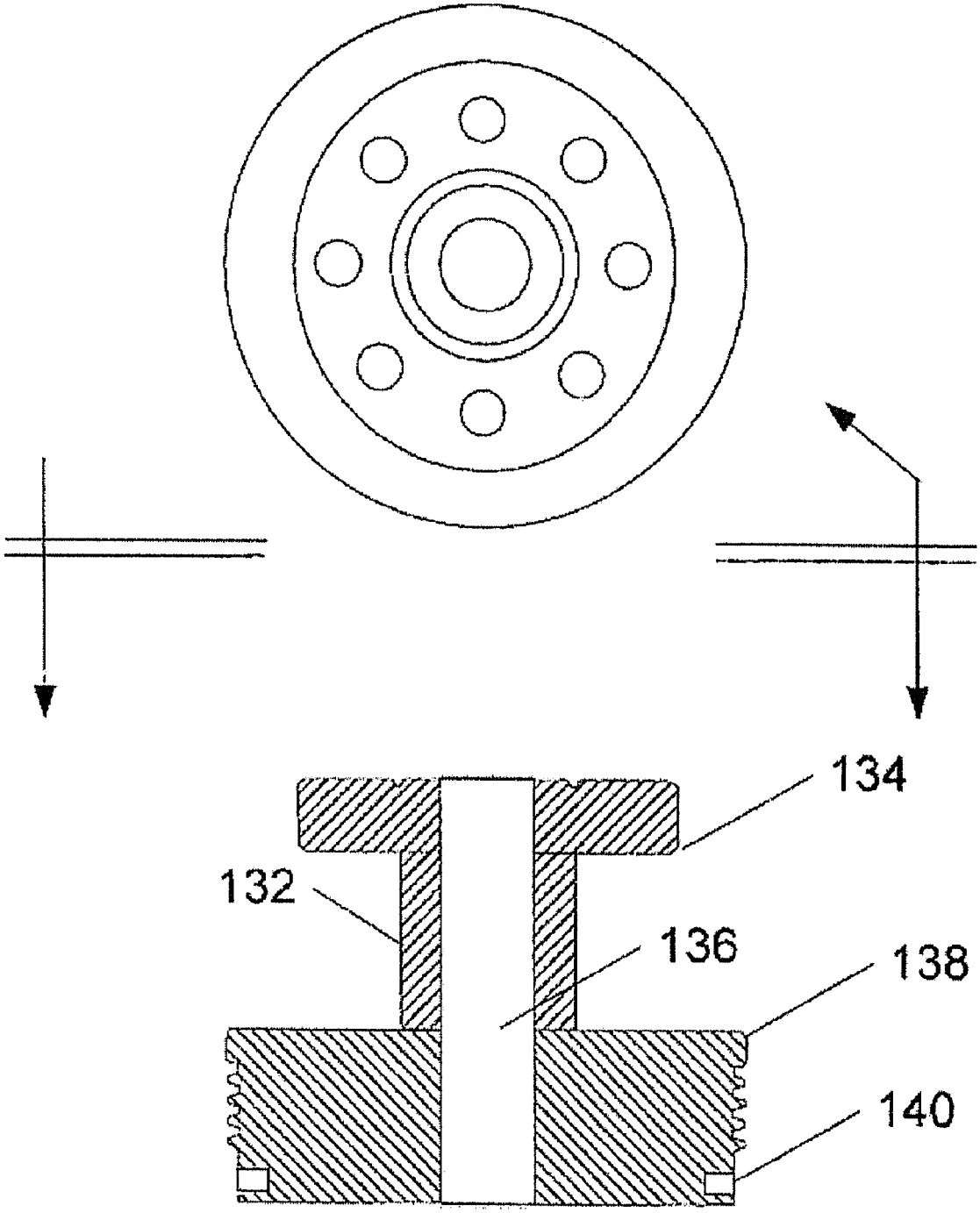
FIG. 7 depicts a test plug.

FIG. 7 depicts a test plug that can be used to test the pressure integrity of the seal of the assembly and BOP equipment prior to final installation of the high pressure adaptor assembly. A test plug would be screwed into the flange 20 not shown in the figure. The test plug has a pipe 132 with a bore 136 for connecting a cap 138 and a pipe pressure attachment 134. It is contemplated that the pipe pressure attachment 134 is a testing flange or a hammer union. A testing seal 140 can be embedded into the cap 138.

In a preferred embodiment, the test plug can be for engaging and testing the pressure integrity of the flange and any pressure control equipment installed below this point. The test plug can be a pipe with a bore for connecting a cap and a pipe pressure attachment. It is contemplated that the pipe pressure attachment can be a testing flange or a hammer union.

In an alternative embodiment, the test plug may have a solid shaft instead of a pipe with a bore for testing purposes. It is contemplated that the seal, can be the same type seal used in hold-down assembly. Preferably, it is an elastomeric O-ring. The assembly may further include a test seal that can be an elastomeric O-ring.

It is also contemplated that the assembly can further comprise as an option, a wireline reentry guide disposed on the lower body for facilitating movement of wireline tools though the bore.

Figure 8:
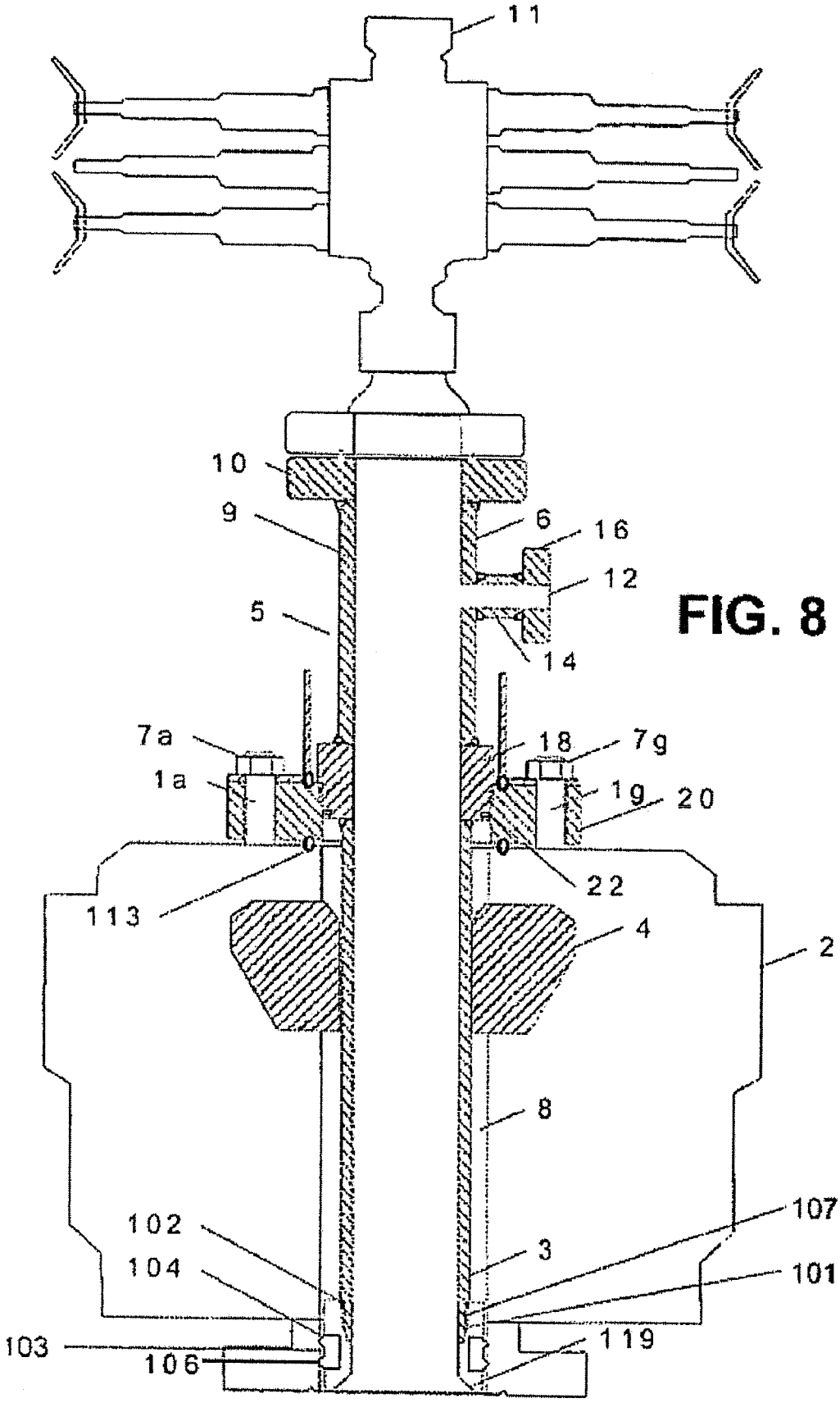
FIG. 8 depicts the installation of the lower seal assembly on the shooting nipple assembly.

FIG. 8 depicts an alternative embodiment of the assembly using a lower seal assembly secured to the lower body 8. FIG. 8 depicts all of the parts of FIG. 4 with the addition of the parts of the lower seal assembly. This lower seal assembly provides a third seal to the annular BOP which enables an BOP to be used in the event the upper seal of the older BOP is non-functional.

As shown in FIG. 8, the lower seal assembly includes an adapter 101 with threads 107 for connecting the adapter 101 to the lower body 8.

A seal 102 is disposed between the adapter 101 and the lower body of the high pressure adaptor. The seal 102 is preferably elastomeric. The seal 102 is even more preferably a lip type seal.

A cup type seal 103 having a first sealing element 104 and a second sealing element 106 wherein the cup type seal is secured to the adaptor 101 midway between the top of the adaptor and the bottom of the adaptor.

A wireline reentry guide 119 can be formed on the end of the adapter opposite the threaded end connecting to the lower body 8.

It should be noted that the shooting nipple assembly with lower seal assembly can be installed inside a riser, interior to a well casing, while allowing drilling and production operations to continue.

This assembly, with the lower seal assembly, can be used in a short piece of pipe casing or with a long piece of casing with a high pressure riser to connect from the surface to depths up to 4500 meters or more.

This equipment enables a small BOP to be used with a large BOP intermittently through the drilling or work over operation.

The assembly can be used in bottom supported offshore platforms, as well as floating drilling and production platforms and operations. This assembly permits easy and fast installation of a small BOP over a large BOP compared to other known systems.

FIG. 9 depicts a cross-sectional detail of the lower seal assembly shown in FIG. 8. The cup type seal 103 having a first sealing element 104 and a second sealing element 106 wherein the cup type seal is secured to the adaptor 101 midway between the top of the adaptor and the bottom of the adaptor seals to the bore of the annular BOP. The cup type seal preferably has a really wide tolerance, so that if the bore is out of specification, such as being more oval than round, the cup type seal will adapt to the change and still yield and effective sealing engagement. A seal 102 is disposed between the adapter 101 and the lower body of the high pressure adaptor. A wireline reentry guide 119 can be formed on the end of the adapter opposite the threaded end. The bore 9 is enclosed by the reentry guide 119.

Another embodiment of the method can be understood with reference to FIGS. 8 and 9. The method involves using a lower seal assembly to engage the lower body 8 and bore 9. This lower seal assembly provides a third seal to the annular BOP which enables a BOP to be used in the event the upper seal of the BOP is non-functional.

as shown in FIG. 8 and FIG. 9, this lower seal assembly includes an adapter 101 having threads for engaging the lower body 8, and a seal 102 disposed between the adapter 101 and the bore of the annular BOP that is a lip type seal.

A cup seal 103 having a first sealing element 104 and a second sealing element 106 is used, wherein the cup type seal is secured to the adaptor 101 midway between the top of the adaptor and the bottom of the adaptor.

A wireline reentry guide 119 is formed to the end of adapter 101 opposite the threaded end connecting to the lower body.

A benefit of this method is that the shooting nipple assembly can be installed inside a riser, which would allow tie-back of a high pressure riser to the surface which is interior to a well casing or riser and allowing drilling and production operations to continue.

This method enables the assembly with the lower seal assembly to be used in a short piece of pipe casing or with a long piece of casing and a high pressure riser to connect from the surface to depths of up to 4500 meters or more.

It is also contemplated that this method permits easy installation for a small BOP over a large BOP and for the intermittent operation, or time to time, as appropriate.

This method can be used in bottom supported platforms as well as floating drilling and production platforms and operations.

To install the lower assembly, the first step is to place a hold down flange though use of its studs and nuts to energize a ring gasket seal. The studs and nuts are preferably torqued to energize the seal and to lock the assembly to the top of the BOP.

The second step is to install a pipe bell nipple to the upper part of the hold down flange. The pipe bell nipple is preferably one that is slightly larger than the working bore of the BOP.

A casing cup tester is installed. A well head test plug could also be used below the main BOP. Either of the testing plugs can be used. The cup tester can test how the casing is attached and the BOP seals. If the well head test plug, it only tests the well head, but not the wellhead to the casing. The purpose of these test plugs is to allow a test for the integrity of the entire BOP and hold down flange. The high pressure assembly is tested separately and off line from the BOP and hold down assembly.

Pressure tests generally apply test pressures between 5000-20,000 psi.

After the test is complete, the test plugs can be removed, and drilling can occur.

In yet another embodiment of the method, a threat protector can be installed between the hold down flange and the pipe bell nipple. After installation of the thread protector, normal drilling operations can occur for full bore and no restrictions can occur. The purpose of the thread protector is to prevent damage to the threads of the hold down assembly, and its seal area from normal drilling operations. In a preferred embodiment, the thread protector is made from steel.

For small bore or reduced diameter bore work, such as wireline work or coiled tubing work, or snubbing work, the high pressure shooting nipple HPSN assembly can be installed by removing any thread protectors from hold down flange, lowering the HPSN into the well and screwing it into the hold down flange.

To effect a primary seal, the annular preventer will be closed onto the lower body of the HPSN. Two other secondary seals are affected, one by screwing the hold down assembly with its lip seal, into the hold down flange, and the other by placing the cup testing seal into the smooth bore of the BOP.

A small bore BOP for wireline or coiled tubing use can then be installed, and small bore work can be performed. After the work is complete, a thread protector can be installed and normal drilling operations can be resumed.

The methods can be used for wells being worked over or newly drilled. The methods can be used in crossing of the BOP from a working diameter to a small diameter while maintaining the full working pressure integrity of the high pressure assembly.

The method has been described in detail with particular reference to certain preferred embodiments thereof, but it will be understood that variations and modifications can be effected within the scope of the method, especially to those skilled in the art.

What is claimed is:

1. A method for rapid installation of a high pressure assembly threadably usable on an annular blow out preventer comprising the steps of:

a. installing a flange with a threaded profile upon an annular blow out preventer with a bore and annular seals;

b. installing a bell nipple on the flange;

c. installing nuts over studs and tightening the nuts;

d. installing a first test plug in a base of the annular blow out preventer or a base of a stack of annular blow out preventers;

e. installing a second test plug into a threaded profile of the flange;

f. performing a pressure test on the flange and all sealing aspects of the annular blow out preventer;

g. depressurizing the flange and removing the first test plug;

h. installing a thread protector between the flange and the bore of the annular blow out preventer;

i. initiating drilling operations;

j. upon indication of a need for small bore operations, installing a high pressure assembly comprising:

i. an upper body and a lower body with a bore that communicates between the upper body and the lower body;

ii. a top flange connected to the upper body for connection with a pressure control device;

iii. a side outlet port disposed in the upper body, integrally connected to the bore having a port body and a side flange, wherein the side flange engages a line for pump in or bleed off of well fluids;

iv. a self energizing hold down assembly comprising a male engagement section disposed between the upper body and the lower body;

v. a threaded flange for connecting to the self energizing hold down assembly comprising a female engagement for engaging with the male engagement section of the self energizing hold down assembly; and vi. wherein installing the high pressure assembly comprises the steps of 1. removing a thread protector;

2. matching the male engagement section of the self energizing hold down assembly to the female engagement section of the flange; and 3. torquing the high pressure assembly until the high pressure assembly is mechanically locked in the flange;

h. forming a wireline reentry guide on the lower body for facilitating movement of wireline tools though the bore.

2. The method of claim 1, wherein small bore operations are selected from the group consisting of: wireline operations, fishing operations, pumping operations, snubbing operations, coil tubing operations, reduced bore operations, and combinations thereof.

3. The method of claim 1, wherein the annular seal is a high pressure seal.

4. The method of claim 1, further comprising the step of welding the self energizing hold down assembly to the upper body using a first weld and welding the self energizing hold down assembly to the lower body using a second weld.

5. The method of claim 1, further comprising the step of using the female engagement section and the male engage section in a threaded intimate relationship to prevent disengagement from the flange.

6. The method of claim 1, wherein the method enables the crossing of the blow out preventer from a working diameter to a small diameter while maintaining a full working pressure integrity of the high pressure assembly.

7. The method of claim 1, wherein the high pressure assembly is for a 7-inch to a 20-inch diameter annular blow out preventers.

8. The method of claim 7, wherein the high pressure assembly is for an 11-inch or a 13⅝ inch working bore annular blow out preventer.

9. The method of claim 1, wherein the first test plug or the second test plug is a pipe with a bore for connecting a cap and a pipe pressure attachment.

10. The method of claim 9, wherein the pipe pressure attachment is a testing flange or a hammer union.

11. The method of claim 1, further comprising using an elastomeric O-ring as the annular seal.

12. A method for rapid installation of a high pressure assembly threadably usable on an annular blow out preventer comprising the steps of:

a. installing a flange with a threaded profile upon an annular blow out preventer with a bore and annular seals;

b. installing a bell nipple on the flange;

c. installing nuts over studs and tightening the nuts;

d. installing a first test plug in a base of the annular blow out preventer or a base of a stack of annular blow out preventers;

e. installing a second test plug into a threaded profile of the flange;

f. performing a pressure test on the flange and all sealing aspects of the annular blow out preventer;

depressurizing the flange and removing the first test plug;

h. installing a thread protector between the flange and the bore of the annular blow out preventer;

i. initiating drilling operations;

j. upon indication of a need for small bore operations installing a high pressure assembly comprising:

i. an upper body and a lower body with a bore that communicates between the upper body and the lower body;

ii. a top flange connected to the upper body for connection with a pressure control device;

iii. a side outlet port disposed in the upper body, integrally connected to the bore having a port body and a side flange, wherein the side flange engages a line for pump in or bleed off of well fluids;

iv. a self energizing hold down assembly comprising a male engagement section disposed between the upper body and the lower body;

v. a threaded flange for connecting to the self energizing hold down assembly comprising a female engagement for engaging with the male engagement section of the self energizing hold down assembly; and vi. wherein installing the high pressure assembly comprises the steps of 1. removing a thread protector;

2. matching the male engagement section of the self energizing hold down assembly to the female engagement section of the flange;

3. torquing the high pressure assembly until the high pressure assembly is mechanically locked in the flange;

k. using a lower seal assembly secured to the lower body of the high pressure assembly for forming a third pressure barrier for the blow out preventer.

13. The method of claim 12, further comprising forming a wireline reentry guide on the lower seal assembly.

14. The method of claim 12, wherein the lower seal assembly comprises:

a. an adapter having a top with threads for engaging the lower body and a bottom;

b. a seal disposed between an adapter and the lower body of the high pressure adapter; and c. a cup-type seal engaging the outer diameter of the adapter having a first sealing element and a second sealing element and secured to the adapter midway between the top and the bottom of the adapter.

15. The method of claim 12, wherein small bore operations are selected from the group consisting of: wireline operations, fishing operations, pumping operations, snubbing operations, coil tubing operations, reduced bore operations, and combinations thereof.

16. The method of claim 12, wherein the annular seal is a high pressure seal.

17. The method of claim 12, further comprising the step of welding the self energizing hold down assembly to the upper body using a first weld and welding the self energizing hold down assembly to the lower body using a second weld.

18. The method of claim 12, further comprising the step of using the female engagement section and the male engage section in a threaded intimate relationship to prevent disengagement from the flange.

19. The method of claim 12, wherein the method enables the crossing of the blow out preventer from a working diameter to a small diameter while maintaining a full working pressure integrity of the high pressure assembly.

20. The method of claim 12, wherein the high pressure assembly is for a 7-inch to a 20-inch diameter annular blow out preventers.

21. The method of claim 20, wherein the high pressure assembly is for an 11-inch or a 13⅝ inch working bore annular blow out preventer.

22. The method of claim 12, wherein the first test plug or the second test plug is a pipe with a bore for connecting a cap and a pipe pressure attachment.

23. The method of claim 22, wherein the pipe pressure attachment is a testing flange or a hammer union.

24. The method of claim 12, further comprising using an elastomeric O-ring as the annular seal.

* * * * *